219-121
2/24/87 XR 4,645,547 SR

United States Patent [19]
Krause et al.

[11] Patent Number: 4,645,547
[45] **Date of Patent: * Feb. 24, 1987**

[54] LOSS FERROMAGNETIC MATERIALS AND METHODS OF IMPROVEMENT

[75] Inventors: Robert F. Krause; Gary C. Rauch, both of Murrysville, Pa.

[73] Assignee: Westinghouse Electric Corp., Pittsburgh, Pa.

[ * ] Notice: The portion of the term of this patent subsequent to Aug. 13, 2002 has been disclaimed.

[21] Appl. No.: 435,822

[22] Filed: Oct. 20, 1982

[51] Int. Cl.[4] ..... H01F 1/04
[52] U.S. Cl. ..... 148/111; 148/112; 148/120; 148/121; 148/306; 148/307; 219/121 LH; 219/121 LJ
[58] Field of Search ..... 148/111, 112, 113, 120, 148/121, 122, 31.5, 31.55, 39; 219/121 L, 121 LH, 12 LJ, 121 LE, 121 LF, 121 LM

[56] References Cited

U.S. PATENT DOCUMENTS

| | | | |
|---|---|---|---|
| 3,192,078 | 6/1965 | Gordon et al. | 148/121 |
| 3,647,575 | 3/1972 | Fiedler et al. | 148/111 |
| 3,948,786 | 4/1976 | Evans | 252/63.5 |
| 3,990,923 | 11/1976 | Takashina et al. | 148/111 |
| 3,996,073 | 12/1976 | Evans | 148/6.15 R |
| 4,203,784 | 5/1980 | Kuroki et al. | 148/111 |
| 4,293,350 | 10/1981 | Ichiyama et al. | 148/111 |
| 4,363,677 | 12/1982 | Ichiyama et al. | 148/111 |
| 4,456,812 | 6/1984 | Neiheisal et al. | 219/121 LM |
| 4,468,551 | 8/1984 | Neiheisal | 219/121 L |
| 4,500,771 | 2/1985 | Miller | 219/121 LH |
| 4,535,218 | 8/1985 | Krause et al. | 219/121 LH |
| 4,548,656 | 10/1985 | Kimoto et al. | 148/111 |

FOREIGN PATENT DOCUMENTS 2468191 4/1981 France .

OTHER PUBLICATIONS

Brailsford, "Magnetic Materials," John Wiley & Sons Inc. (1960), pp. 1–5.
Bozorth, "Ferromagnetism," D. Van Nostrand Co., Inc., (1951), pp. 1–5.
Nakamura et al., "Characteristics of Losses of Irradiated Grain Oriented Silicon Steel", preprint of paper presented Jul. 21, 1982, Montreal, Canada.
A. H. Clauer et al., "Pulsed Laser Induced Deformation in a FE-3 WT Pct Si Alloy", Metallurgical Transactions A, vol. 8A, Jan. 1977, pp. 119–125.
A. H. Clauer et al., "Effects of Laser Induced Shock Waves on Metals", Shock Waves and High-Strain--Rate Phenomena in Metals, Ed by Meyers et al., (1981), pp. 675–680.
T. Iuchi et al., "Laser Processing for Reducing Core Loss of Grain Oriented Silicon Steel", presented at 27th Annual Conference on Magnetism and Magnetic Materials, Nov. 10–13, 1981, Atlanta, GA, U.S.A.

*Primary Examiner*—John P. Sheehan
*Attorney, Agent, or Firm*—R. A. Stoltz

[57] ABSTRACT

It has been found that ferromagnetic sheet material can be scribed in order to reduce watt losses by a thermal method involving rapid heating of small areas or narrow bands of the material in a manner that produces sudden thermal expansion to a degree sufficient to produce plastic deformation within the thermally treated zone. This method has been found to be particularly applicable to electrically insulative coated ferromagnetic sheet wherein it has been found that a laser operating in a continuous wave or extended pulse mode can produce the desired deformation in the ferromagnetic material without damage to the coating properties.

15 Claims. 16 Drawing Figures

% REDUCTION IN CORE LOSS
14
12
10
8
6
4
2
0
-2
-14
1
2
3
4
5
6
7
P.S -1/2

LOSS FERROMAGNETIC MATERIALS AND METHODS OF IMPROVEMENT

CROSS-REFERENCE TO RELATED APPLICATIONS

R. A. Miller U.S. Pat. No. 4,500,771 based on copending U.S. patent application Ser. No. 435,443, filed concurrently with the present application, entitled "Apparatus and Process for Laser Treating Sheet Material."

R. F. Krause, G. C. Rauch and W. H. Kasner, U.S. Pat. No. 4,535,218 based on copending U.S. patent application Ser. No. 435,444, filed concurrently with the present application, entitled "Laser Scribing Apparatus and Process" For Using.

Both of the aforementioned applications relate to high speed laser scanning machines and the processes for using them to laser scribe ferromagnetic sheet material. These applications are hereby incorporated by reference.

BACKGROUND AND SUMMARY OF THE INVENTION

The present invention pertains to the treatment of ferromagnetic material to refine magnetic domain spacing and the resultant products produced thereby. It is especially concerned with the non-physical contact scribing of ferromagnetic sheet and laminations, and the products produced thereby.

The development of high permeability grain oriented silicon steel for use in magnetic cores, (e.g. transformer cores) resulted in a significant reduction in core loss, especially at inductions greater than 1.5 T (15 kG). This reduction in loss has been achieved primarily by improvements in the degree of grain orientation. Separation of the components contributing to the overall core loss has shown that the improved losses obtained are due to a reduction in the hysteresis component of the core loss. Further loss reductions can be achieved by refining the 180° domain wall spacing, which results in a lowering of the eddy current component of core loss.

Over the past several years techniques have been developed to reduce the domain wall spacing by changing the magnetostatic or the magnetoelastic energy in the sheet. Insulative coatings that apply a tensile stress parallel to the rolling direction have been effective in reducing the domain wall spacing and the core loss. Mechanical, or physical, scribing transverse to the sheet rolling direction is another technique that has been found to be effective in reducing domain spacing and lowering the losses. The disadvantages of mechanical scribing are that the insulative coating is disturbed, and the space factor is decreased.

Efforts to obtain the advantages of scribing without the aforementioned disadvantages have centered around the use of pulsed laser scribing techniques. It is known that irradiation of an iron-silicon alloy by a laser pulse of sufficient power density can vaporize material at the alloy surface or insulative coating surface causing a pressure shock wave to travel through the alloy causing dislocations and twins (see A. H. Clauer et al, "Pulsed Laser Induced Deformation in an Fe-3Wt Pct Si Alloy," Metallurgical Transactions A, Vol. 8A, January 1977 pp. 119–125). This deformation, like the deformation produced by mechanical scribing, can be used to control domain spacing. In fact, pulsed lasers have been applied to grain oriented electromagnetic steel sheet to produce shock wave induced arrays of deformation.

(see, for example, U.S. Pat. No. 4,293,350 and French Patent Application No. 80/22231 published on Apr. 30, 1981 Publication No. 2,468,191). It has however been reported that pulsed laser scribing after an insulating film has been applied to the major surfaces of the ferromagnetic steel sheet is likely to result in removal of the insulating film in the irradiated areas causing a deterioration in the film's insulating properties, corrosion protection properties and ability to withstand high voltage (see for example European Patent Application Publication No. 0033878 A2). While this coating damage can be repaired by recoating after laser scribing, the coating applied should be curable at a temperature below about 600° C. to avoid annealing out the beneficial effects of laser scribing. Recoating is also undesirable because of it being an additional step in the manufacturing process.

In accordance with the present invention applicants have discovered that the domain size, and therefore the watt losses, in a ferromagnetic sheet material can be reduced by a process involving the rapid heating of narrow bands of the ferromagnetic sheet material to an elevated temperature, preferably below the material's solidus, and immediately thereafter self-quenching the heated material. In this manner it is believed that plastic deformation is produced within the thermally treated material due to the stresses developed in it because of the constraints imposed on its thermal expansion by the surrounding relatively cold material.

It has also been surprisingly discovered that when the method of scribing according to this invention is applied to ferromagnetic material which has been previously coated with a film of electrically insulative material that the ferromagnetic material can be scribed, while maintaining the insulative properties of the film. The method according to this invention preferably does not change the surface roughness of the film or cause the film to melt.

Also in accordance with the present invention it is preferred that the thermal treatment used to produce the scribe lines be conducted by an energy beam operating in a continuous mode as it impinges on and travels across the sheet. It has been found that a CW (continuous wave) laser beam is useful for these purposes.

Neodymium YAG or Neodymium glass and $CO_2$ lasers are suitable for use in the present invention.

The material to be treated by this process includes both coated and uncoated ferromagnetic sheet material having a large domain size, such as that found in grain oriented and high permeability grain oriented silicon electrical steels. This invention may also be applied to iron-nickel alloys, iron-cobalt alloys, iron-nickel-cobalt alloys and amorphous ferromagnetic materials, which can also benefit by the reduction in domain size produced by scribing in accordance with the present invention.

The aforementioned and other aspects of the present invention will become more apparent upon examination of the drawings, which are briefly described below, in conjunction with the detailed description of the invention.

DETAILED DESCRIPTION OF THE INVENTION

Figure 1:
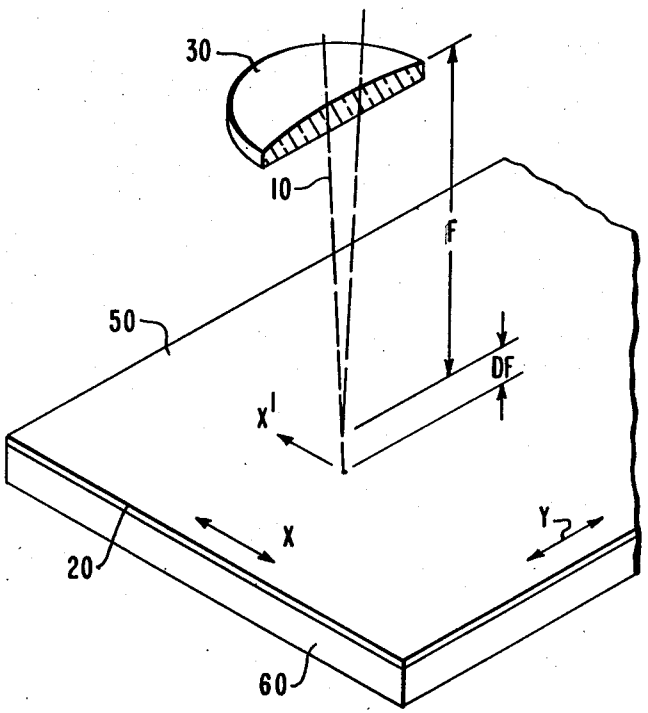
FIG. 1 shows an embodiment of a laser scanning process according to the present invention.

In accordance with the present invention applicants have discovered that it is possible to reduce watt losses in sheets of ferromagnetic material having an insulative coating by scribing said material with a laser beam operating in a continuous wave or extended pulse mode. It has been found that under the appropriate laser scanning parameters the magnetic domain size of the material can be refined without damage to the insulative or surface roughness properties of the coating.

It is applicants' belief that the advantageous results of the present invention are due to the rapid heating of a narrow band of material by the laser to an elevated temperature below the solidus and the immediately following rapid self quenching of the heated band of material. A difference in temperature is created between the laser treated and surrounding untreated material which is large enough to produce plastic deformation, or residual stresses, within the thermally treated band due to the stresses developed in it during the treatment because of the constraints imposed on its thermal expansion by the surrounding relatively cold material.

To achieve these conditions, while avoiding damage to the coating, the laser must be able to rapidly heat the narrow band of material to the elevated temperature required without the production of a plastic shock wave, and preferably without causing melting of the material. Applicants have found that these requirements can be met if a laser is utilized to produce a beam having a power density of less than that required to produce shock deformation in the material (see A. H. Clauer et al, "Effects of Laser Induced Shock Waves on Metals," Shock Waves and High-Strain-Rate Phenomena in Metals, ed. by M. A. Meyers et al, Plenum Publishing Corp., N.Y., N.Y., (1981) p. 675. Pages 676 through 680 of this article are hereby incorporated by reference.), while producing an incident energy density input of greater than 10 and less than about 200 joules/cm$^2$. Power density below about $1 \times 10^6$ watts/cm$^2$ with a dwell time of less than about 10 milliseconds (to avoid melting), and providing the above energy densities are believed to be suitable for these purposes. It has been found using high permeability grain oriented silicon steel having an insulative stress coating that significant improvements in watt losses can be obtained if the incident power density is between about $1. \times 10^3$ and $1. \times 10^5$ watts/cm$^2$ with a dwell time preferably of about 0.1 to 5. milliseconds to produce an incident energy density of about 11 to 50 joules/centimeter$^2$. It should be noted that for the purposes of the present invention, a pulse laser, or continuous wave laser operating in a pulse mode, and having an extended pulse duration meeting the above requirements, are also useful.

The improvements obtained further depend upon the width of the deformation zone produced by the laser and the spacing between deformation zones. While not wishing to be bound by theory the applicants believe that the understanding of, use of, and the advantageous results obtained from, the present invention can be furthered by the following theory:

The mechanism by which the laser scribing process according to this invention produces domain refinement has not been fully established. Nonetheless, in the absence of shock deformation effects, it is our belief that the extent of localized heating is an important factor, perhaps leading to localized deformation because of constrained thermal expansion. For most of the dwell times and laser beam spot sizes used in the present invention it is believed that as a first approximation one can assume that most heat flows downward into the material with little heat loss occurring in other directions. For an idealized one dimensional heat flow model the change in temperature should be described by equation (1) as follows:

$$\Delta T = \frac{2\alpha I}{k}\left(\frac{\kappa t}{\pi}\right)^{\frac{1}{2}} \quad (1)$$

where $\Delta T$=maximum increase in surface temperature (°K.)

I=incident beam power intensity (W/cm$^2$)

t=dwell time of beam on surface (sec)

$\kappa$=thermal diffusivity (cm$^2$/sec)

k=thermal conductivity (W/cm.°K.)

$\alpha$=absorptance

If one further assumes that the beam spot has a uniform power density over its diameter or length, d, instead of the typical gaussian distribution, the dwell time at the center of the beam trace, or scribe line, is given by $$t = d/S \quad (2)$$

where S is the scan speed.

The incident beam power, P, is given by $$P = AI = \frac{\pi d^2}{4} I \text{ (round spot)} \quad (3)$$

where A is the area of the beam spot with uniform power intensity. Combining equation (1), (2) and (3) produces $$\Delta T = \frac{8\kappa^{\frac{1}{2}}\alpha\, P}{\pi^{3/2}\, k\, d^{3/2}\, S^{\frac{1}{2}}} \quad (4)$$

or, for a given material, beam geometry and size, and laser wavelength $$\Delta T \propto P \cdot S^{-\frac{1}{2}} \quad (5)$$

While it is not believed that equation (4) will provide a quantitatively accurate ΔT for the complex situation actually existing during laser treatment, it is believed that equation (4) can be useful for making qualitative comparisons and predictions of power, speed and energy requirements between different materials. The parameter $P \cdot S^{-\frac{1}{2}}$ for a given material, laser wavelength, beam geometry and size, and scribe line spacing, has been found to be a useful plotting variable for the core loss changes produced by the present invention.

The invention will be further clarified by a consideration of the following examples, which are intended to be purely exemplary of the invention.

First, samples of mill glass coated TRAN-COR H (a Trademark of the Armco Inc. of Middletown, Ohio) were obtained. TRAN-COR H is a high permeability grain-oriented silicon steel using AlN inhibition to promote secondary recrystallization.

The mill glass coating is a magnesium silicate glass having a typical thickness of about 1 to 2 microns. The mill glass coating is formed on the steel by standard techniques well known in the art. These techniques typically include: applying a MgO-water slurry to the steel strip; strip annealing to dry the coating; and then box annealing the coiled strip, typically at about 1200° C., to produce a secondary recrystallized grain structure in the steel while simultaneously forming a $MgSiO_4$ glass on the surface (the silicon being picked up from the silicon steel itself).

Mill-glass-coated TRAN-COR H was sheared into Epstein strips, randomized, and stress relief annealed at 800° C. for 2 hours in a dry hydrogen atmosphere and furnace cooled. Sheet thickness was approximately 0.0104 inches.

The first example set consisted of laser scribing three 9-strip Epstein sets of the TRAN-COR H with a $CO_2$ laser operating at approximately 32 watts in the CW (continuous wave) mode. The laser used was a Photon V150 150 watt $CO_2$ laser manufactured by Photon Sources, Inc. of Livonia, Mich. As shown in FIG. 1, the beam 10 was passed through a 2.5-inch focal length lens 30 that was intentionally defocused, DF, 0.100 inch at the specimen surface 50 to obtain a beam spot size of about 22 mils in diameter on the specimen surface. The energy distribution within the spot was gaussian. The specimens 20 were affixed by a magnetic chuck to a numerically controlled X-Y table 60 and rastered back and forth under the laser beam 10. The laser beam path X′ was transverse (i.e. perpendicular) to the rolling direction Y. Scribe spacing was 0.25 inch for all three sample sets. The scribing speed was varied for the three sample sets; sample set LS-MG-1 was scribed at 50 ipm (inches per minute), sample set LS-MG-2 was scribed at 100 ipm, and sample set LS-MG-3 was scribed at 200 ipm, Table I. Both surfaces were scribed; the scribe lines were registered one below the other.

After scribing, eight strips from each set were tested at 60 Hz. The 60 Hz-demagnetized domain wall spacing and the domain wall pattern in the laser-affected regions were observed on the remaining Epstein strip with the mill-glass coating intact. One strip from each sample set was metallographically examined. The coating was removed with a 50% solution of hot HCl and the sample polished then etched with 5% Nital.

The coated surface was examined by light and scanning electron microscopy (SEM) for damage, and the surface profile was measured parallel to the rolling direction.

TABLE I

LASER SCRIBING EXAMPLES
Example Set I

| Specimen Set Identification | Scan Speed (in./min.) | Scribe Spacing (inch) | Defocus (inch) | Incident Power (W) | Incident* Power Density (W/cm.$^2$) | Dwell* Time (sec.) | Incident Energy* Density (J/cm.$^2$) |
|---|---|---|---|---|---|---|---|
| LS-MG-1 | 50 | .25 | .100 | ~32 | $\sim 1.3 \times 10^4$ | $\sim 2.6 \times 10^{-2}$ | $\sim 3.4 \times 10^2$ |
| LS-MG-2 | 100 | .25 | .100 | ~32 | $\sim 1.3 \times 10^4$ | $\sim 1.3 \times 10^{-2}$ | $\sim 1.7 \times 10^2$ |
| LS-MG-3 | 200 | .25 | .100 | ~32 | $\sim 1.3 \times 10^4$ | $\sim 7 \times 10^{-3}$ | $\sim 9.1 \times 10^1$ |
| LS-MG-4 | | | | CONTROL | | | |

*Approximate values calculated based on ~22 mil diameter round spot and treating the gaussian energy distribution as being constant across the spot diameter.

TABLE II

MAGNETIC PROPERTIES OF LASER SCRIBED TRAN-COR H

| Specimen Set Number | 10 KG | | 13 KG | | 15 KG | | 17 KG | |
|---|---|---|---|---|---|---|---|---|
| | $P_c$ (W/lb) | μ | $P_c$ (W/lb) | μ | $P_c$ (W/lb) | μ | $P_c$ (W/lb) | μ |
| LS-MG-1 | .358 | 2,500 | .537 | 2,800 | .686 | 2,800 | .894 | 2,500 |
| LS-MG-2 | .243 | 9,500 | .388 | 9,900 | .508 | 9,700 | .664 | 8,300 |
| LS-MG-3 | .200 | 33,400 | .333 | 30,900 | .447 | 27,200 | .597 | 18,000 |
| LS-MG-4 (control) | .243 | 36,800 | .377 | 42,100 | .489 | 44,500 | .647 | 30,800 |

Figure 2:
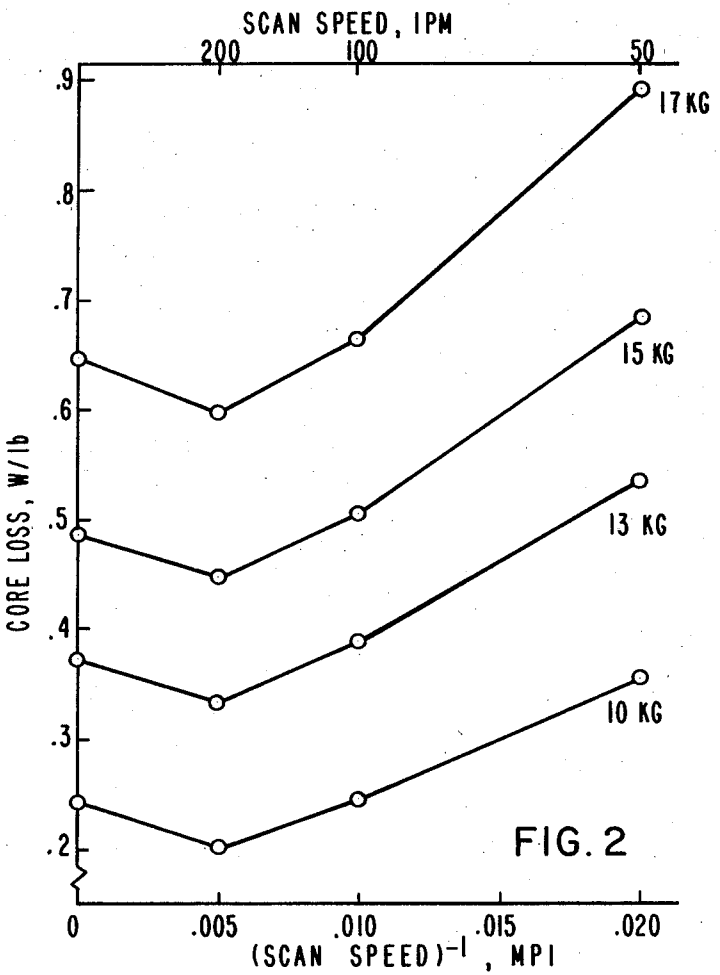
FIG. 2 shows the core loss as a function of CW laser scanning speed for laser scribed high permeability grain oriented silicon steel sheet.
Figure 3:
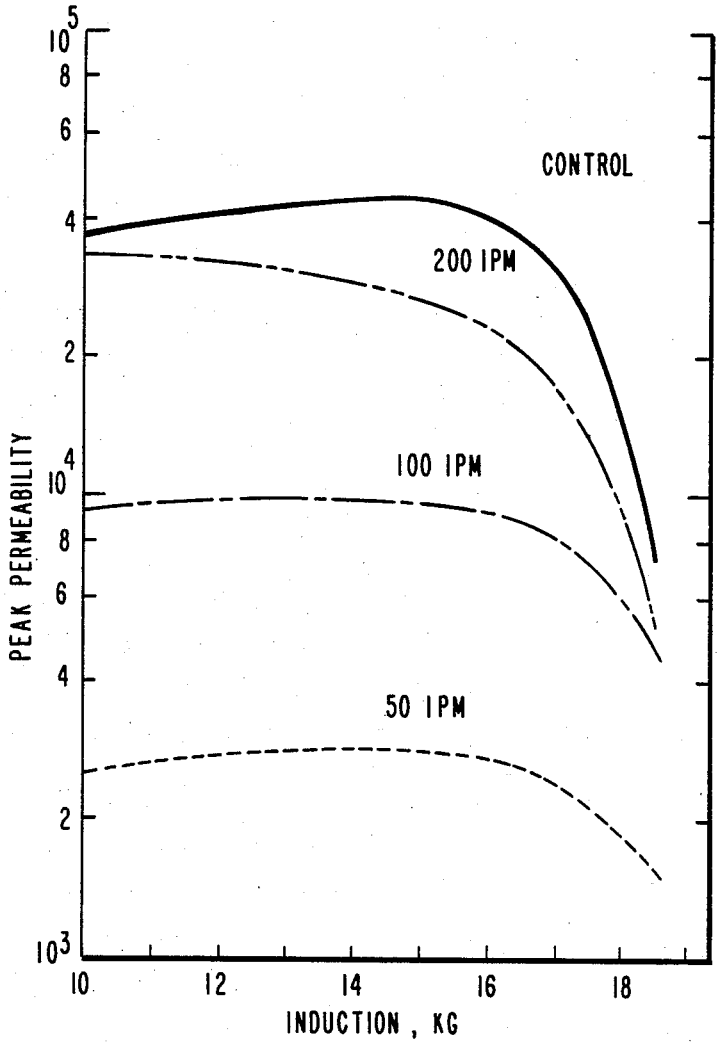
FIG. 3 shows the peak permeability as a function of CW laser scan speed for material scribed at various laser scanning speeds.

The relationship between the total core loss and the scan speed is shown in FIG. 2. At the low scan speeds (50 and 100 ipm) the laser-induced damage increased the core loss, while scanning at 200 ipm resulted in decreased losses. The permeability was decreased at all three scribing conditions, FIG. 3.

Figure 4:
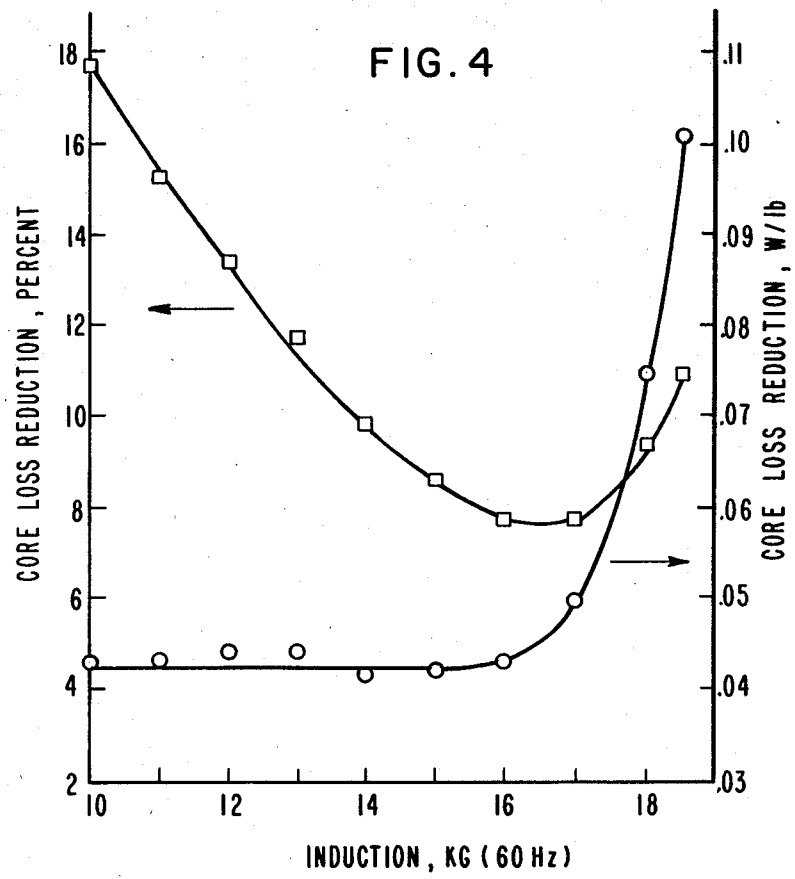
FIG. 4 shows the variation in the reduction in core loss with flux density for an embodiment of a laser scribed sheet in accordance with the present invention.

The variation of the reduction in core loss with flux density for example LS-MG-3 is shown in FIG. 4. For flux densities up to about 16 kG, the core loss reduction is more or less constant at 0.043 W/lb. Above 16 kG the core loss reduction increases as the flux density increases. The percent core loss reduction decreases with increasing flux density to 17 kG, then increases.

Figure 5:
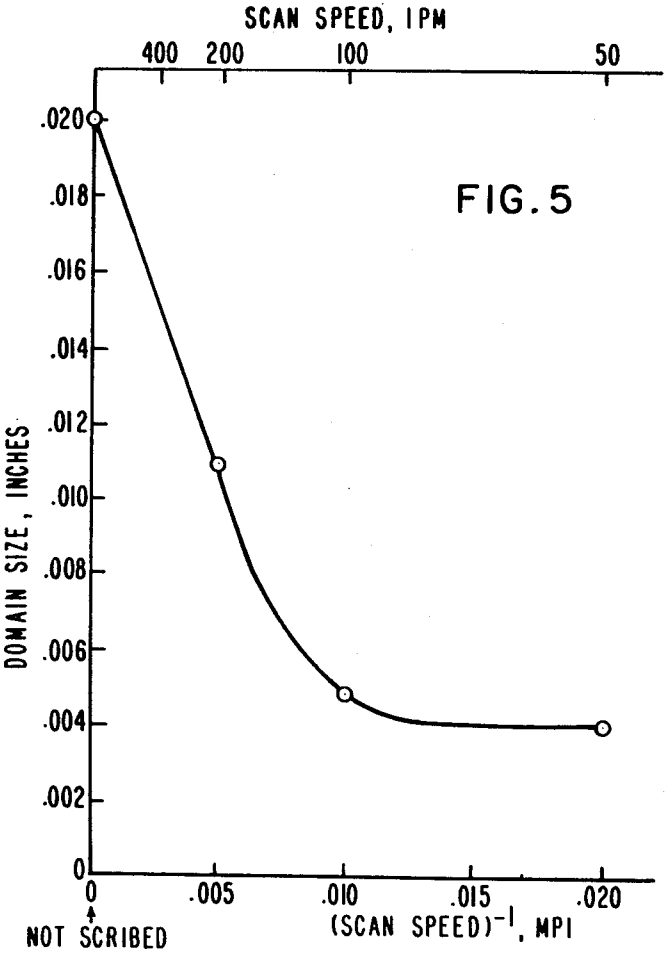
FIG. 5 shows the effect of laser scanning speed on the 180° domain wall spacing for laser scanning speeds of 50 to 200 inch/minutes.
Figure 7:
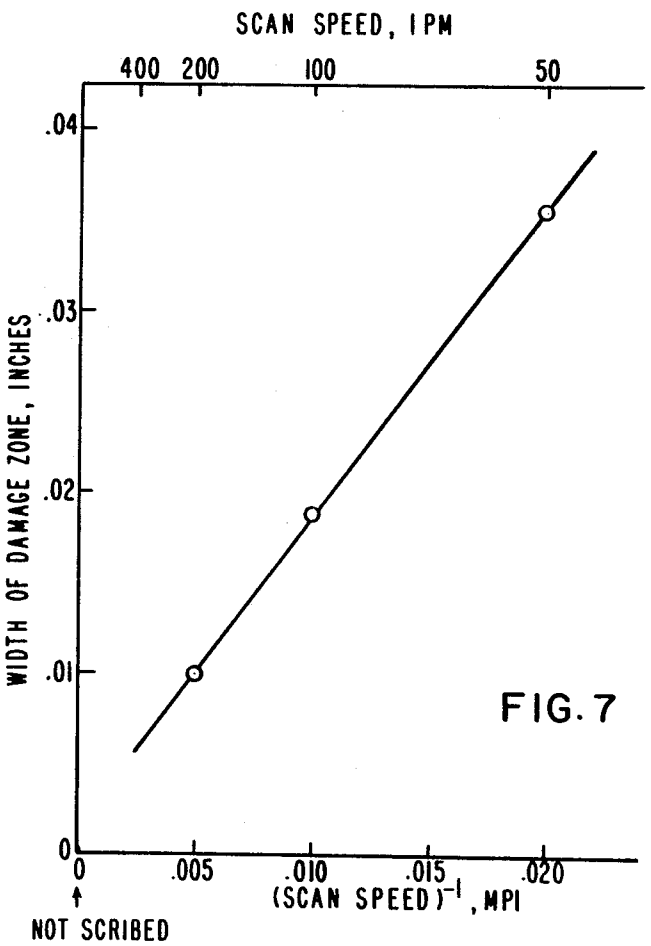
FIG. 7 shows the effect of laser scribing speed on the width of the damage zone.
Figure 6:
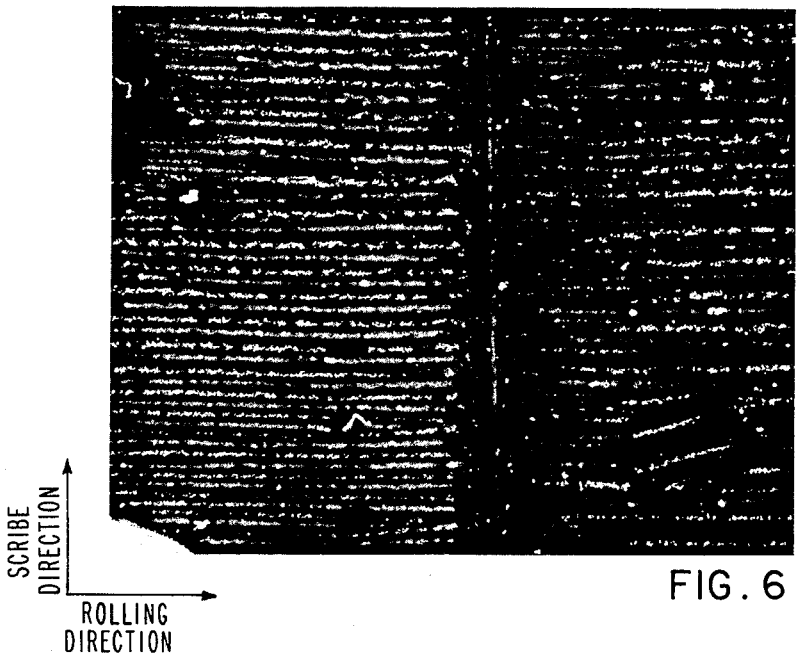
FIG. 6 shows a typical domain configuration within and between scribed zone produced by laser scribing in accordance with the present invention.

The 180° domain wall spacing decreases with decreasing scan speed, as shown in FIG. 5. The domain configuration for sample LS-MG-2 with a laser scribed zone of width Z is shown in FIG. 6. The width of the damage zones, in which the 180° domain structure is disrupted, increases as the laser scan speed decreases, FIG. 7.

Examination of the insulative coating revealed no visual damage for samples LS-MG-2 and LS-MG-3. Sample LS-MG-1, which was laser treated at a scan speed of 50 ipm, did show some coating discoloration although Nomarski microscopy failed to reveal any coating damage. Examination of the coating surface by SEM also failed to reveal coating damage.

Surface profiles made on samples LS-MG-2 and LS-MG-3 were similar to the control sample, LS-MG-4. The surface profile run on LS-MG-1 did reveal a slight but abrupt increase in the sample thickness in the laser scribed regions; the sample thickness increased approximately 0.1 mils in the scribe zones.

Figure 8:
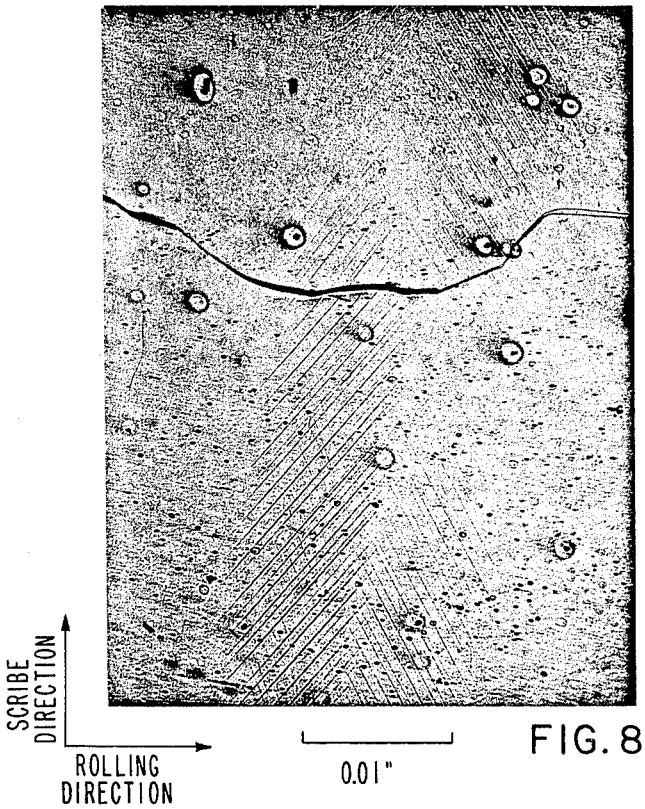
FIG. 8 shows a micrograph of the deformation produced within the steel in a laser scribed zone.

Examination of a planar section of the steel (sample LS-MG-2) revealed chevron-like slip or twin lines in the laser affected zones near the steel-coating interface, FIG. 8. The angle between the intersecting lines was about 70°. A 70.5° angle corresponds to the angle between <111> directions, the slip and twin direction in BCC silicon steel.

In a second set of examples a series of CARLITE-3 coated TRAN-COR H Epstein sets were laser scribed using the setup shown in FIG. 1.

CARLITE-3 is an ARMCO Trademark for an aluminum-magnesium-phosphate-chromium silica insulative glass stress coating typically of about 3–4 microns in thickness, and bonded to, and over the mill glass coating. This coating is typically cured at a temperature above 600° C. This stress coating applies tension to the underlying silicon steel and thereby produces magnetic domain refinement. CARLITE-3 and related insulative stress coatings and methods of applying them directly to silicon steel and mill glass coated silicon steel are described in U.S. Pat. No. 3,948,786 which is hereby incorporated by reference.

The CARLITE-3-coated TRAN-COR H steel utilized in the following examples were 8 strip Epstein sets cut from a 30-inch wide coil. The Epstein samples were stress relief annealed for 15 minutes at 805° C. in helium .

Laser scribing on one side of the above samples was performed using a 5-inch focal length lens, defocused 0.197 inch at powers of 20 and 30 watts, and scan speeds ranging from 100 to 600 inches per minute. Some of the various combinations of laser scanning parameters and the results produced are shown in Table III.

TABLE III

PARAMETERS AND RESULTS OF LASER SCRIBING TREATMENTS

| Spec. | Lens f.l. (in.) | Defocus (in.) | Power, P (W) | Speed, S (in/min.) | Power* Density (W/cm.$^2$) | Dwell* Time (sec.) | Energy* Density (J/cm.$^2$) | $P \cdot S^{-\frac{1}{2}}$ / $W \cdot min^{\frac{1}{2}}$ / $in.^{\frac{1}{2}}$ | Scribe Spacing (in.) |
|---|---|---|---|---|---|---|---|---|---|
| 34 | 5 | .197 | 30 | 400 | $1.2 \times 10^4$ | $3.3 \times 10^{-3}$ | 40 | 1.50 | 0.25 |
| 35 | 5 | .197 | 30 | 600 | $1.2 \times 10^4$ | $2.2 \times 10^{-3}$ | 26 | 1.22 | 0.25 |
| 39 | 5 | .197 | 20 | 100 | $8.2 \times 10^3$ | $1.3 \times 10^{-2}$ | 107 | 2.00 | 0.25 |
| 38 | 5 | .197 | 20 | 200 | $8.2 \times 10^3$ | $6.6 \times 10^{-3}$ | 54 | 1.41 | 0.25 |
| 46 | 5 | .197 | 20 | 300 | $8.2 \times 10^3$ | $4.3 \times 10^{-3}$ | 35 | 1.15 | 0.25 |
| 37 | 5 | .197 | 20 | 400 | $8.2 \times 10^3$ | $3.3 \times 10^{-3}$ | 27 | 1.00 | 0.25 |
| 45 | 5 | .197 | 20 | 400 | $8.2 \times 10^3$ | $3.3 \times 10^{-3}$ | 27 | 1.00 | 0.25 |
| 36 | 5 | .197 | 20 | 600 | $8.2 \times 10^3$ | $2.2 \times 10^{-3}$ | 18 | 0.82 | 0.25 |

| % Change in Core Loss (60 Hz) | | | % Change in A.C. Permeability | | | | Damage Width | |
|---|---|---|---|---|---|---|---|---|
| 13 kG | 15 kG | 17 kG | 13 kG | 15 kG | 17 kG | Visibility** | (in.) | Spec. |
| −1.4 | −0.2 | 0.3 | −52 | −56 | −56 | 0 | .013 | 34 |
| −6.6 | −5.2 | −4.0 | −20 | −29 | −33 | 0 | .011 | 35 |
| 24.2 | 22.2 | 21.0 | −80 | −79 | −75 | 1 | .035 | 39 |
| −3.7 | −2.6 | −1.4 | −37 | −42 | −41 | 0 | .024 | 38 |
| −7.1 | −5.3 | −4.2 | 6 | −10 | −19 | 0 | .008 | 46 |
| −8.4 | −7.1 | −6.4 | 12 | −1 | −11 | 0 | .008 | 37 |
| −7.5 | −6.4 | −6.0 | 11 | 3 | −8 | 0 | .007 | 45 |
| −5.0 | −4.7 | −4.5 | 9 | 5 | −3 | 0 | .013 | 36 |

*All values in the approximations based on a calculated spot diameter of 0.022 inches for a spot having a gaussian energy distribution, setting the outer limit of the spot at the radius where the energy has fallen to 1/e of its maximum, and then treating the energy distribution as constant over that diameter.

**0 = Not visible.

1 = Slightly visible.

Core loss and permeability changes are shown as a percentage of the starting loss or permeability, so that a negative change in core loss represents an improvement, and a positive change in permeability indicates an increase in permeability. The parameter, $P \cdot S^{-\frac{1}{2}}$, involving power and speed will be discussed shortly. Also shown in Table III is a qualitative indication of the visibility of the scribe lines, and a measure of laser damage zone width.

It is apparent from Table III that core loss improvement generally declines with increasing induction from 13 to 17 kG, as observed in the previous example using mill-glass-coated TRAN-COR H. The general level of improvement is consistent with that found for the mill-glass-coated material. In many cases, also, the scribe lines are essentially invisible.

Figure 9:
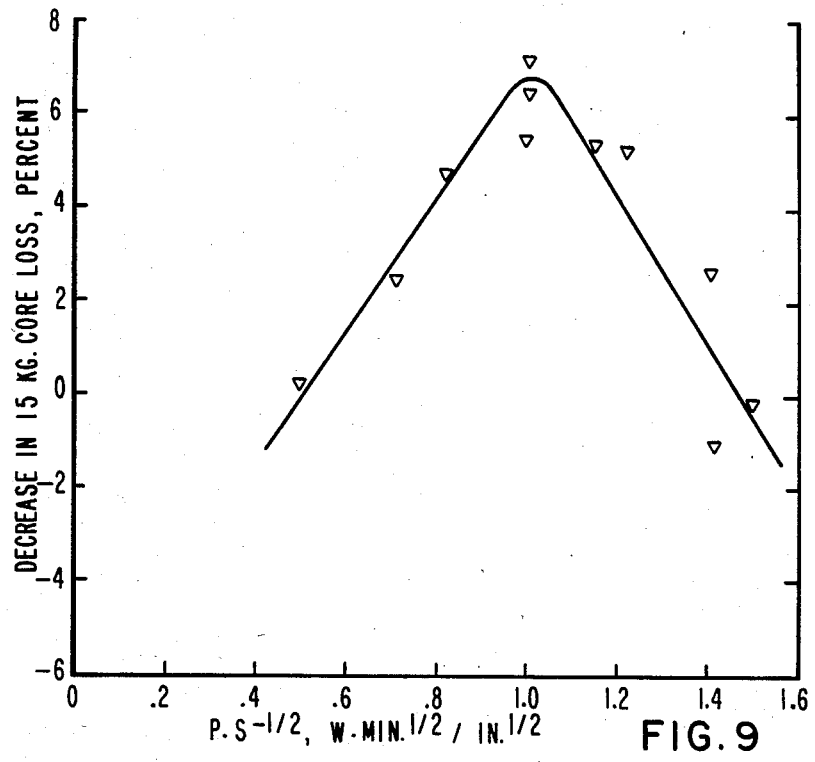
FIG. 9 shows 15 kG core loss as a function of the parameter $P \times S^{-\frac{1}{2}}$, where P=power and S=scan speed.

The 15 kG core loss changes are shown in FIG. 9. (A positive percent decrease in core loss represents a reduction in core loss, a negative decrease, an increase in core loss.) Not only does $P \cdot S^{-\frac{1}{2}}$ appear to be a useful parameter for specifying optimum scribing conditions, but the level of core loss change for the various combinations of power and speed has been found to be a function of $P \cdot S^{-\frac{1}{2}}$.

Figure 10:
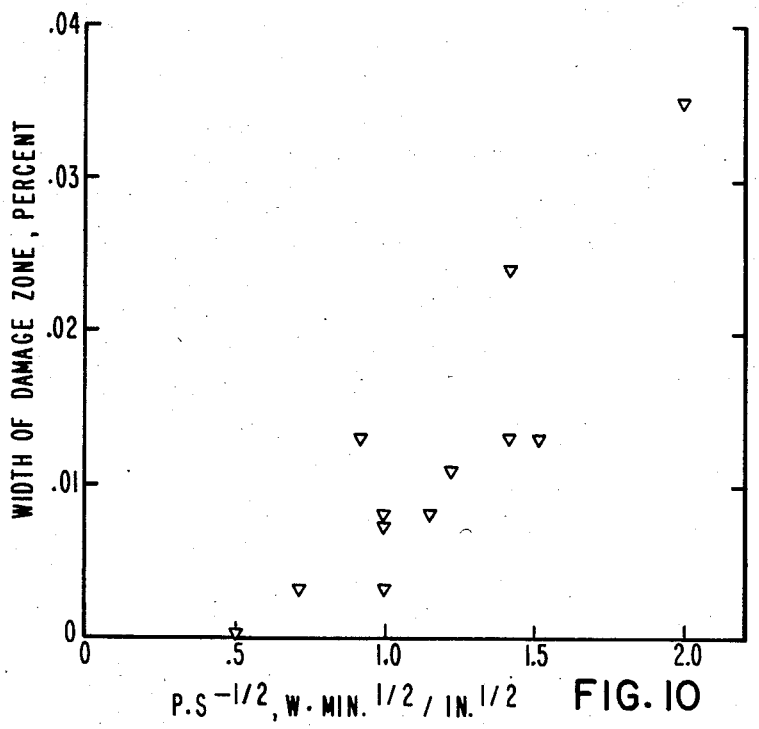
FIG. 10 shows the width of the laser damage zone as a function of $P \times S^{-\frac{1}{2}}$.

The laser damage zone was defined as the laser-affected region in which the 180° domain structure was disrupted by what are evidently surface closure domains in regions of compressive stress. The measured damage zone width is shown in Table III, and the damage width is shown as a function of $P \cdot S^{-\frac{1}{2}}$ in FIG. 10. The damage width increases as $P \cdot S^{-\frac{1}{2}}$ increases.

Scanning electron microscopy (SEM) showed that some of the scribe lines were not visible even at magnifications of 1000×, generally confirming visual examination. Specimens 35 and 37 were examined as examples; no trace of the beam path was visible.

$P \cdot S^{-\frac{1}{2}} = 1.6$. For the corresponding beam size, the best condition found for the CARLITE-3-coated steel was 20 W at 400 in/min, $P \cdot S^{-\frac{1}{2}} = 1.0$.

Equation (4) can be used to estimate the maximum surface temperature increase for these two cases, taking account of the different reflectances and the values of optimum $P \cdot S^{-\frac{1}{2}}$. Substituting into Equation (4) for 3% Si-Fe:

TABLE IV

SPECIMENS FOR WHICH THICKNESS PROFILES WERE MEASURED

| Specimens | Lens f.l. (in.) | Defocus (in.) | Power (W) | Speed (in/min.) | $\Delta P_{c15}$* (%) | $\Delta\mu_{15}$* (%) | Visibility** | Thickness Change at Scribe Line (in.) | Thickness Change at Scribe Line (μm) |
|---|---|---|---|---|---|---|---|---|---|
| 34 | 5 | .197 | 30 | 400 | 2.5 | −63 | 0 | 0 | 0 |
| 37 | 5 | .197 | 20 | 400 | −6.1 | −9 | 0 | 0 | 0 |
| 39 | 5 | .197 | 20 | 100 | 19.1 | −84 | 1 | $+6 \times 10^{-5}$ | +1.5 |

*Scribed on both sides with scribe zones on one side registered over scan zone on the other side. Spacing was 0.25".
**0 = Not Visible.
1 = Slightly Visible.

Selected specimens were studied using a profilometer which measured total thickness of the strip. Surface damage was expected to appear as a change in thickness. The specimens for which profiles were obtained are listed in Table IV, which also includes other relevant data for those specimens, from Table III.

It is apparent from Table IV that $CO_2$ laser scribing in the range of optimum conditions causes little measurable effect. A 1.5 μm thickness increase, the maximum observed (for heavily laser-damaged specimen 39), represents only a 0.5% change in thickness at the scribe locations. This small increase is easily observed using the profilometer emphasizing that any undetected changes in the more-nearly optimum specimens must be quite small, less than approximately 0.2 μm.

It is desirable that space factor be as high as possible, and that secondary treatments such as laser scribing not reduce the space factor. In fact, one of the significant potential disadvantages of mechanical scribing is the decrease in space factor associated with any movement of metal out of the scribe groove without removing it completely from the sheet. We have found that laser scribing using the conditions that gave good loss improvements did not reduce space factor.

We also found that Franklin current is not increased by the laser scribing conditions studied, showing that the insulation provided by the coating is not decreased.

The significant result of this set of examples is that the core loss reductions observed previously in laser-scribed mill-glass-coated high-permeability electrical steel are also found in stress-coated material, and that little or no coating damage is associated with CW $CO_2$ laser scribing. Also important are the implications that the $P \cdot S^{-\frac{1}{2}}$ dependence has for higher-speed scribing.

Equation (1) indicates that the temperature increase expected during laser irradiation is directly proportional to the fraction, $\alpha$, of the incident energy that is absorbed. Although we could not measure the absorptance $\alpha$ directly, equipment was available to measure the reflectance, R, relative to a polished aluminum surface. At the $CO_2$ laser wavelength of 10.6 μm, the reflectance of the stress-relief-annealed CARLITE-3-coated material was 22% and that of the mill-glass-coated steel used in our earlier examples was 55%.

One would expect for this reason that the optimum scribing conditions for the two steels would be different, and they are. The best scribing condition found for the mill-glass material was 32 W at 400 in/min and $$R = 1 - \alpha$$

$$k = 0.17 \text{ W/cm-°C.}$$

$$\kappa = 0.048 \text{ cm}^2/\text{sec}$$

$$d = 0.022 \text{ in} = 0.056 \text{ cm}$$

leads to $$\Delta T = 680\,(1 - R)\,(P \cdot S^{-\frac{1}{2}}) \tag{7}$$

with $(P \cdot S^{-\frac{1}{2}})$ expressed in units $W \cdot min^{\frac{1}{2}}/in^{\frac{1}{2}}$. Using the measured R and the indicated values of $P \cdot S^{-\frac{1}{2}}$, $$\Delta T_{mill\text{-}glass} = (680)(0.45)(1.6) = 490° \text{ C.}$$

and $$\Delta T_{CARLITE\text{-}3} = (680)(0.78)(1.0) = 530° \text{ C.}$$

The agreement is quite good, providing additional support for the validity of the $P \cdot S^{-\frac{1}{2}}$ parameter. In this approximate analysis we have assumed one-dimensional heat flow and have implicitly considered the coating to be transparent. No coating changes were observed for either case analyzed above.

While the invention has been demonstrated by the preceding examples using a $CO_2$ CW laser it is believed that acceptable results would also be obtained for example, using a Neodymium YAG or Neodymium glass laser operating in a continuous wave or extended pulse mode. The optimum parameters, however, would probably differ since specimens with coatings such as mill glass and CARLITE-3 reflect very little of the 1.06 micron wavelength light emitted by these lasers (see equation (1)).

The relationship $P \cdot S^{-\frac{1}{2}}$ indicates that high speed laser scribing is possible without the need to linearly increase power with increasing scan speed. However, as scan speed increases, dwell time decreases for a given round spot diameter, and would ultimately lead to coating damage due to shock induced effects produced by the higher power densities required to get the needed energy density. Applicants have discovered that this limitation on scan speed can be overcome by changing the beam spot geometry from a round to an elongated one, wherein the major dimension of the spot is aligned parallel to the scanning direction. In this manner the laser dwell times, power densities, and beam width required by the process according to this invention to avoid coating damage can be maintained while scan speed can be greatly increased. For example, such an elongated spot can be produced by substituting a cylindrical lens for the convex spherical lens utilized in the previous examples and shown schematically in FIG. 1. Preferably, however, it is believed that even higher laser scanning speeds can be attained if one of the systems and processes described in copending application Ser. Nos. 435,443 (now U.S. Pat. No. 4,500,771) and 435,444 (now U.S. Pat. No. 4,535,218) are utilized in conjunction with the present invention. These copending applications are hereby incorporated by reference.

Figure 12:
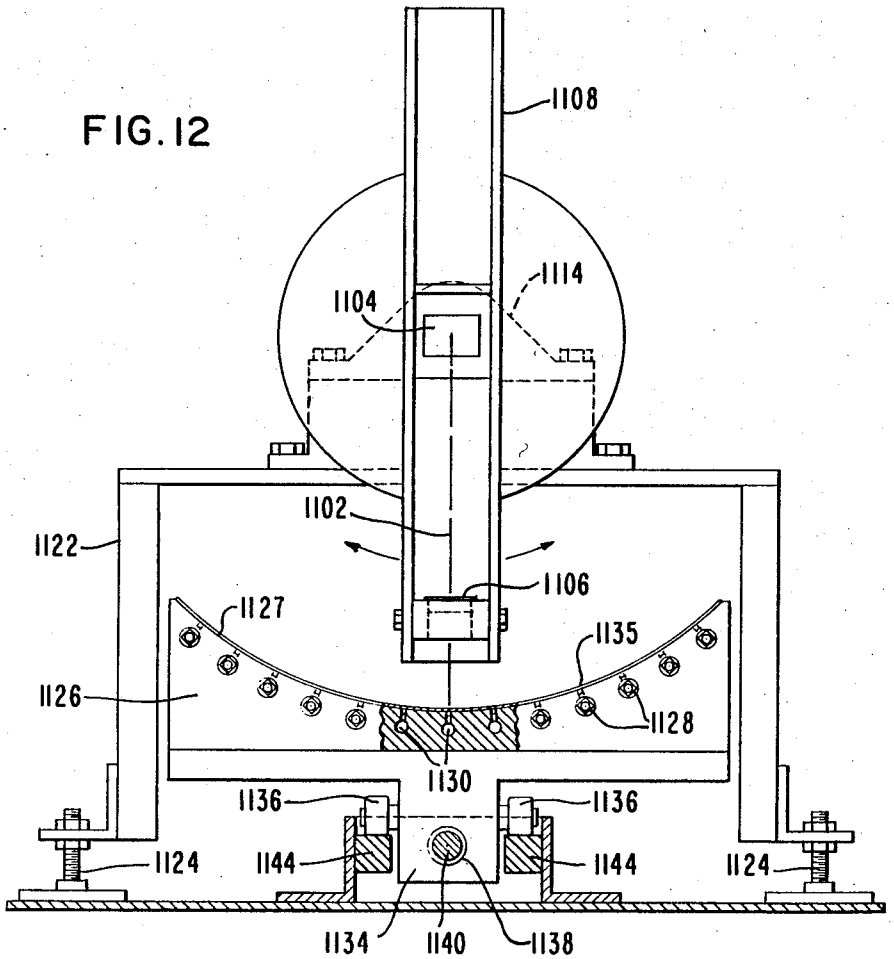
FIGS. 11–12 show various views of a high speed laser scribing apparatus utilized by this invention.
Figure 11:
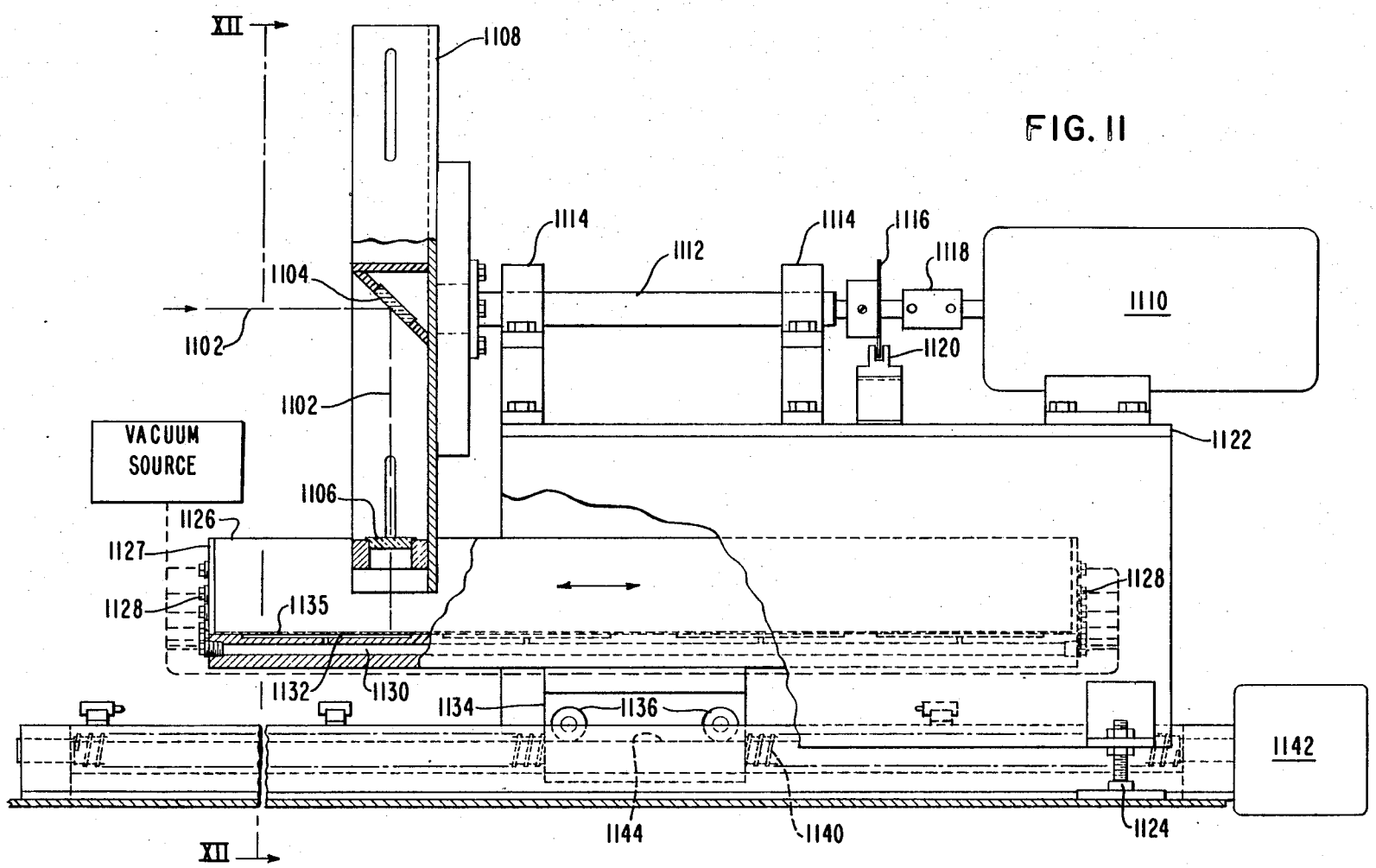

FIGS. 11 and 12 illustrate an embodiment of a high speed laser scanning apparatus utilized by the inventors in the following examples of high speed laser scanning processes. FIG. 11 shows a partially broken away side view of the laser scanning apparatus. A diagonal mirror 1104 is shown mounted in the rotational center of support arm 1108 which adjustably holds at one end a cylindrical lens 1106. The diagonal mirror 1104 is optically aligned with the cylindrical lens 1106 such that an incident beam of laser light 1102 aligned with the axis of rotation of the diagonal mirror 1104 will be deflected by mirror 1104 through lens 1106. Cylindrical lens 1106 then focuses the beam 1102 into an elongated spot on the ferromagnetic sheet 1135 surface. A gold coated stainless steel mirror 1104, and zinc selenide lenses 1106 were used in the following examples.

The support arm 1108 is mounted on a steel shaft 112 which is coupled by coupling 1118 to a DC variable speed motor 1110. The steel shaft 1112 is rotatably mounted in yokes 1114 containing ball bearings. The yokes 1114 are in turn mounted on a hollow base member 1122. Mounted on the steel shaft 1112 is a tachometer ring 1116. The tachometer ring 1116 has an inner circle of holes extending axially through it and at least one axial hole at a radius different from the circle of holes. These holes pass between two pairs of LEDs (light emitting diodes) and photo optic sensors 1120 mounted on the hollow base member 1122.

The first LED and photo optic sensor pair is arranged to be interrupted by the ring of holes and sends an electrical signal to a display device that shows the rotations per minute based on the frequency with which the light emitted by the LED is interrupted.

The second LED and photo optic sensor pair are arranged with the other hole. The electric signal obtained from this arrangement is sent to the laser source and allows for the triggering of the laser beam only when the beam is incident on the ferromagnetic sheet, and if desired, only every second, third, etc. pass over the sheet 1135.

Located within the hollow base member 1122, but not an integral part thereof, is a sheet table 1126 for holding the ferromagnetic sheet 1135 which will be scribed by the laser. The table 1126 has an upward facing cylindrical surface 1127 which appears concave when viewed on end, as in FIG. 12. As seen in FIG. 12, surface 1127 defines an arc having a radius of curvature equal to the distance between it and the rotational axis of the diagonal mirror 1104 so that the laser beam hitting the ferromagnetic sheet 1135 held on surface 1127 will always have the same degree of focus along its entire path across the sheet 1135.

The ferromagnetic sheet 1135 is held against concave surface 1127 by means of a vacuum chucking system. Arranged in an arclike array within table 1126 and beneath surface 1127 are a series of passageways 1130 which are connected with slots 1132 opening up on concave surface 1127. Flexible vacuum lines are connected at 1128 to passageways 1130. The sheet 1135 is then fixed against the concave surface 1127 when a partial vacuum is established in passageways 1130 and slots 1132. In this manner the upper surface of the sheet takes on a concave shape which is held during the entire laser treatment cycle.

The lower portion of the table 1126 is mounted upon a truck 1134 having wheels 1136 which allows the entire table 1126 and truck 1134 assembly to be rolled within tracks or channel 1144. Within the truck a threaded axial hole 1138 extends from its front to its back. The truck 1134 is nonrotatably mounted on and threadedly engaged to, long rotatable screw 1140 which can be driven by another variable speed motor 1142 to which it is connected. Rotation of screw 1140 causes table 1126 to translate axially along the length of the screw.

Looking at FIG. 12, it can be seen that the table 1126 is aligned such that the rotational centerline of the sheet 1135 on the cylindrical surface is as closely as possible coincident with the axis of rotation of the diagonal mirror 1104. Accurate alignment is aided by the downwardly extending adjustable feet 1124 of base member 1122. The radius of curvature of the concave surface 1127 used in the following examples was 10 inches.

Using the device shown in FIGS. 11 and 12 nominally 12 mil thick sheets (by 16" wide, by 26" long) of CARLITE-3 coated TRAN-COR H were laser scribed on one side only using the processing parameters shown in Table V.

TABLE V

HIGH SPEED LASER SCRIBING PARAMETERS AND RESULTS

| Spec. | Lens f.l. (in.) | Defocus (in.) | Rotational Speed (rpm) | Rotational Speed (ipm) | Table Translation Speed (ipm) | Incident Power* (W) | Incident Power Density* (W/cm.$^2$) | Dwell Time* (sec.) |
|---|---|---|---|---|---|---|---|---|
| 80 | 5 | 0 | 500 | 31400 | 63 | 450 | $3.5 \times 10^4$ | .001 |
| 95 | 5 | 0 | 375 | 23600 | 47 | 300 | $2.3 \times 10^4$ | .0013 |
| 114 | 2.5 | 0 | 500 | 31400 | 63 | 450 | $3.5 \times 10^4$ | .001 |
| 126 | 2.5 | 0 | 1250 | 78500 | 52 | 450 | $3.5 \times 10^4$ | .0004 |
| 144 | 2.5 | 0 | 1250 | 78500 | 39 | 450 | $3.5 \times 10^4$ | .0004 |
| 146 | 2.5 | 0 | 1250 | 78500 | 78 | 450 | $3.5 \times 10^4$ | .0004 |

| Incident Energy Density* (J/cm.$^2$) | Laser on Frequency (pass) | Scribe Spacing (in.) | % Change in Core Loss (60 Hz) 10 kG | 13 kG | 15 kG | 17 kG | $P \cdot S^{-\frac{1}{2}}$ / $W \cdot min^{+\frac{1}{2}}$ in.$^{\frac{1}{2}}$ | Spec. |
|---|---|---|---|---|---|---|---|---|
| 35 | second | .23 | −12.7 | −9.7 | −8.0 | −8.4 | 2.54 | 80 |
| 30 | second | .25 | −10.5 | −7.8 | −6.1 | −5.7 | 1.95 | 95 |

TABLE V-continued

| HIGH SPEED LASER SCRIBING PARAMETERS AND RESULTS | | | | | | | | |
|---|---|---|---|---|---|---|---|---|
| 35 | second | .24 | −12.5 | −10.1 | −7.8 | −7.6 | 2.54 | 114 |
| 14 | third | .12 | −11.2 | −9.5 | −8.4 | −8.0 | 1.61 | 126 |
| 14 | every | .028 | −0.4 | 0 | −1.0 | −3.2 | 1.61 | 144 |
| 14 | sixteenth | .96 | −2.1 | −1.5 | −1.9 | −2.0 | 1.61 | 146 |

*These values are approximations based on the simplifying assumptions that: (1) the incident beam spot was of a constant size for all incident power levels; (2) the beam spot was a rectangle 0.5" × .004"; and (3) that the power density was constant across the entire beam spot area.

A cylindrical lens was used in each case to provide an elongated elliptical spot aligned perpendicular to the direction of travel of the table and having an effective zone of approximately 0.003–0.004 inches by 0.5 inches. A $CO_2$ CW laser beam was provided by a Photon Sources Model V500, 500 watt laser. The beam as it entered the cylindrical lens was circular in cross-section and had a gaussian energy distribution.

Figure 13:
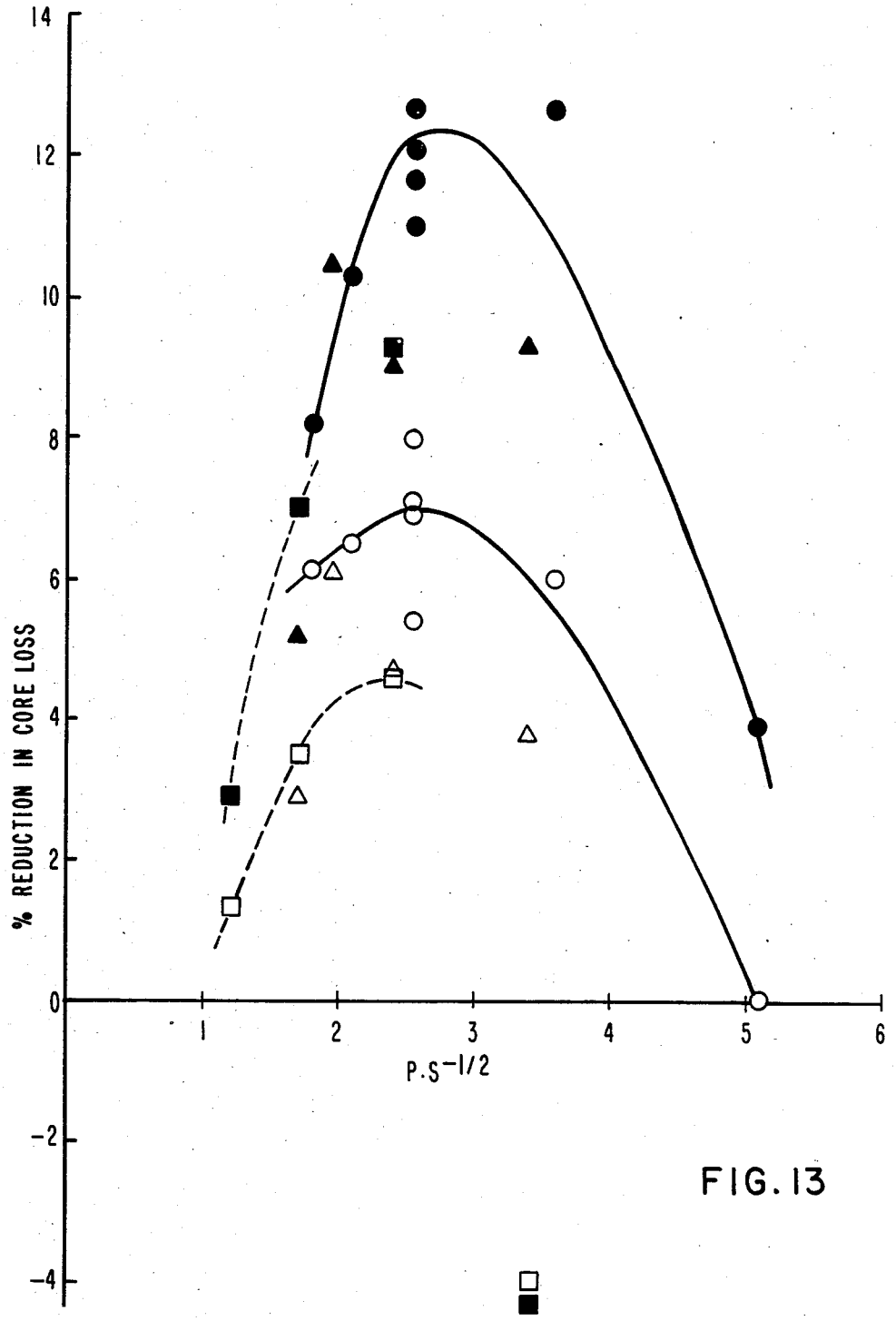
FIGS. 13–14 show the percent core loss reduction produced according to this invention as a function of $P \times S^{-\frac{1}{2}}$ for various high speed laser scanning parameters.
Figure 14:
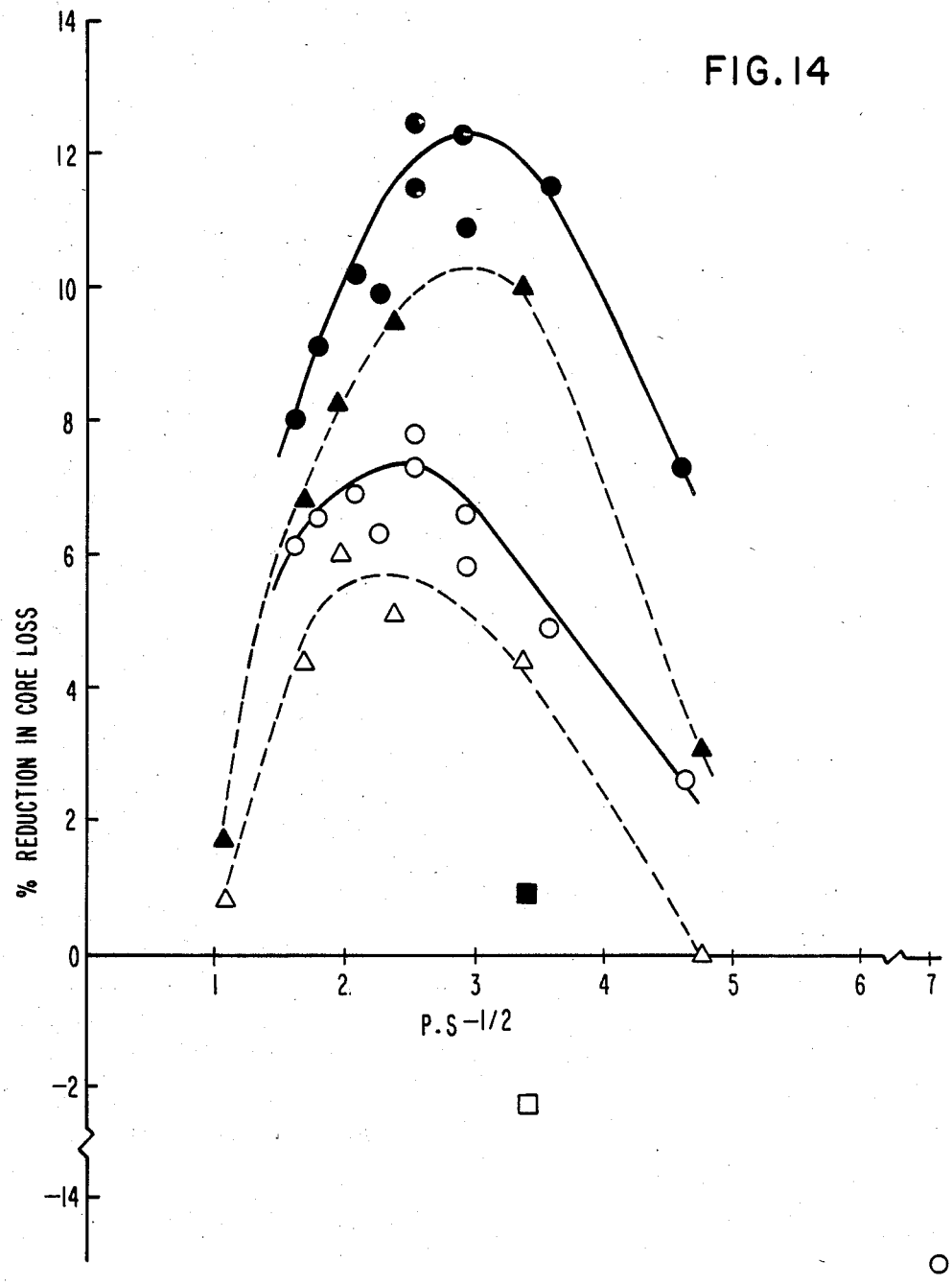

The changes in core loss at inductions of 10 (■, ▲, ●) and 15 (□, △, ○) kG as a function of $P \cdot S^{-\frac{1}{2}}$ (watt $min^{\frac{1}{2}}/in^{\frac{1}{2}}$) as measured on the treated, single full width sheets are plotted in FIGS. 13 and 14 for a 5" focal length lens and a 2.5 inch focal length cylindrical lens respectively. It can be seen that there are optimum values of $P \cdot S^{-\frac{1}{2}}$ for which the core loss reduction is maximized. At a given induction separate core loss curves were produced for each laser power evaluated (150 (■, □), 300 (▲, △), and 450 (●, O) W) probably due to the wide variation in power having an effect on the spot size produced on the sheet.

The data plotted in FIGS. 13 and 14 utilized a nominal 0.25 inch scribe spacing. For a given power, spot size, and geometry, different scanning speeds have different optimum scribe spacings for producing optimum core loss improvements. Where significant improvements were made in core loss there typically was no damage and little visual evidence of scribing seen in the coating. For the higher $P \cdot S^{-\frac{1}{2}}$ values shown (i.e. greater than 4.5 to 5.0) there may be some minor melting of the coating at pre-existing surface flaws on the coating. At the lower $P \cdot S^{-\frac{1}{2}}$ values shown (i.e. less than 1) it is believed that the energy or power density was insufficient to produce enough of a sudden temperature increase to produce stresses having a significant effect on domain size for the scribe spacing being evaluated.

Figure 15:
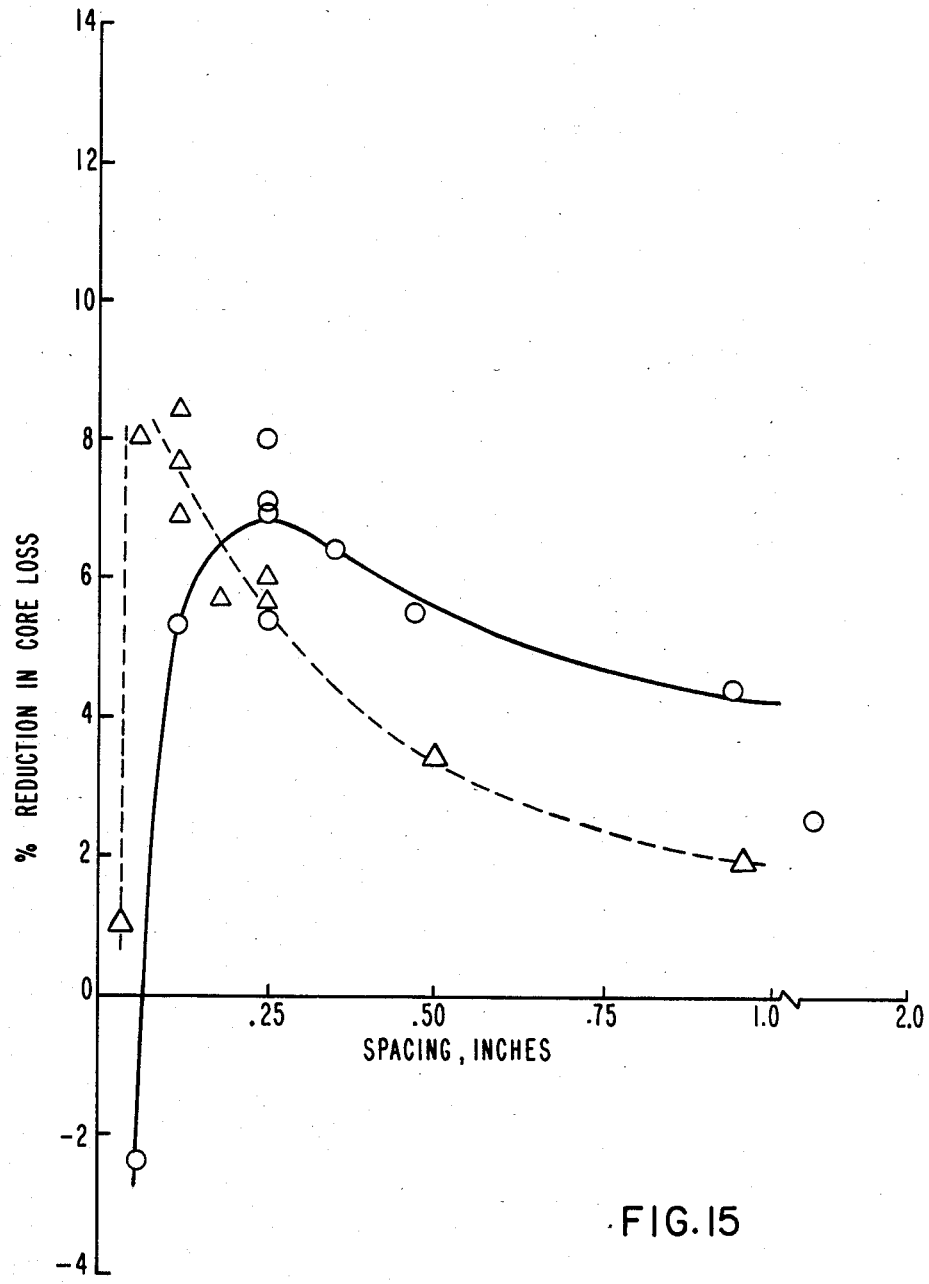
FIG. 15 shows the percent core loss reduction as a function of the spacing between scribe lines for two high speed laser scanning processes.

FIG. 15 shows the variation in percentage reduction in core loss plotted against scribe spacing for scanning speeds of about 31400 (O) and about 78500 (△) inches per minute using a 450 watt beam. The optimum scribe spacing for the 31400 ipm scribe speed is about 0.25 inches and the optimum scribe spacing for the 78500 ipm speed is about 0.07–0.12 inches.

Figure 16:
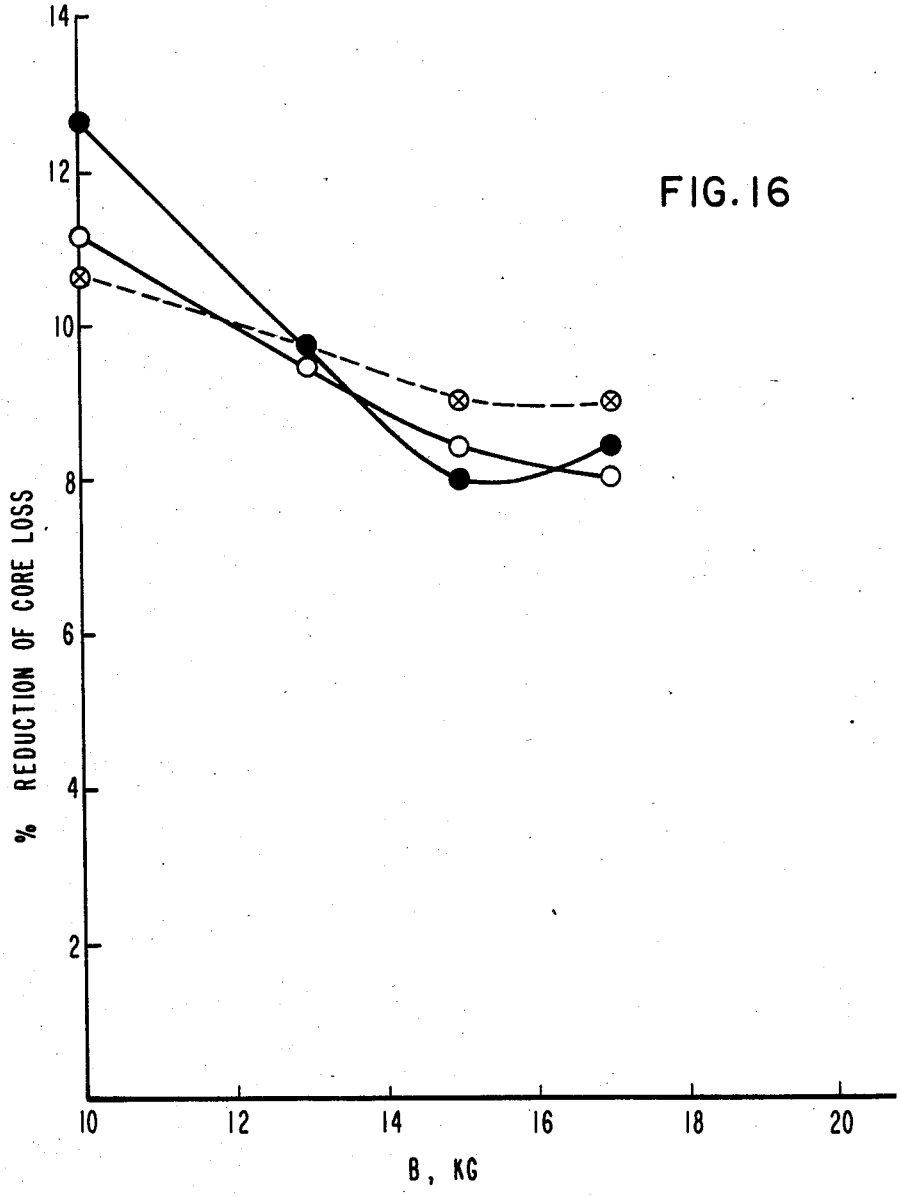
FIG. 16 shows percent core loss reduction as a function of the induction for three sets of laser scanning parameters.

The variation in the percent reduction in core loss as a function of induction is shown in FIG. 16 for a 450 watt beam used to scribe at 31400 ipm with a 0.25 inch spacing (●) and 78500 ipm with a 0.12 inch spacing (O).

Also shown in FIG. 16 are 78500 ipm., 0.12 inch spacing results with a circular $\frac{3}{8}$ inch diameter aperture placed in the path of the incoming ~$\frac{1}{2}$ inch diameter round 450 watt beam to produce an elliptical beam spot on the sheet surface of about 0.004 inch × $\frac{3}{8}$ inch (⊗).

In another example utilizing the laser scribing device shown in FIG. 11 (with cylindrical lens having a 5 inch focal length) a sheet of CARLITE-3 coated TRANCOR H was scribed using the $CO_2$ laser operating in an extended pulse mode. The beam power was 450 watts with a 1 millisecond pulse and 11 milliseconds between pulses. The laser scan speed at the specimen surface was 1947 ipm. These parameters produced a beam spot on the specimen surface of about 0.004 inch × about 0.5 inch with about a 0.14 inch overlap between pulses. The table speed was 8 inches per minute and the laser was pulsed on every rotational pass over the sheet to produce a scribe spacing of 5/16 inch. The scribe lines produced were visible to the naked eye and produced watt loss improvements of: 10.8% at 10 KG; 8.0% at 13 KG; 6.2% at 15 KG; and 5.8% at 17 KG.

While the preceding examples have all dealt with high permeability grain oriented silicon steel scribed by lasers operating in a CW or extended pulse mode, the present invention is also applicable to conventional grain oriented silicon steel as demonstrated by the following examples utilizing the apparatus of FIG. 11.

Mill glass coated regular grain oriented silicon steel sheet having a nominal thickness of 0.009 inches was laser scribed using the $CO_2$ laser operating in a CW mode at 450 watts power and the 5-inch focal length cylindrical lens focused on the sheet surface. Scribing was performed at 250 RPM and a table speed of 31 ipm. The laser was switched on for every pass over the sheet to produce a 0.125 inch nominal scribe spacing. The percent improvement in watt losses obtained based on a full width single sheet test were as follows: 7.9% at 10 kG; 5.7% at 13 kG; 5.1% at 15 kG; and 8.6% at 17 kG.

Similar tests were performed on CARLITE-3 coated regular grain oriented silicon steel as shown in Table VI after CW $CO_2$ laser treatment using the FIG. 11 Apparatus.

TABLE VI

| Spec. | 12 | 13 |
|---|---|---|
| Cylindrical lens f.l. (in.) | 2.5 | 2.5 |
| Defocus (in.) | 0 | 0 |
| Scan Speed (ipm) | 47100 | 62800 |
| Translation Speed (ipm) | 31 | 63 |
| Incident Power (W) | 450 | 450 |
| Laser On Frequency (pass) | third | second |
| Scribe Spacing (in.) | .12 | .12 |
| 60 Hz % Change in Core Loss | | |
| 10 kG | −4.2 | −4.2 |
| 13 kG | −3.3 | −3.3 |
| 15 kG | −3.2 | −3.3 |
| 17 kG | −4.1 | −4.9 |

As can be seen by the improvements in core loss obtained the present invention is applicable to regular grain oriented silicon steel as well as high permeability-grain oriented silicon steel. This invention is also applicable to other coated or uncoated ferromagnetic materials, however it should be understood that the optimum laser conditions and the improvement in core loss obtained may vary from material to material.

For all the examples presented scribing was performed with a laser operating in a continuous wave or extended pulse mode scanned across the entire sheet width to produce a scribe line transverse to the material rolling direction (i.e. at 90° thereto). Substantially transverse scribing, that is within 45° of the transverse direction, is also contemplated.

Other embodiments of the invention will become more apparent to those skilled in the art from a consideration of the specification or practice of the invention disclosed herein. It is intended that the specification and examples be considered as exemplary only, with the true scope and spirit of the invention being indicated by the following claims.

We claim:

1. A process for improving the watt losses and reducing the permeability in a ferromagnetic sheet material, wherein said process comprises the steps of:

repeatedly traversing a laser beam across the width of said ferromagnetic sheet at spaced intervals along the length of said ferromagnetic sheet;

said laser beam rapidly heating narrow bands of said ferromagnetic sheet to a temperature below the solidus temperature of said material;

immediately thereafter rapidly self-quenching said narrow bands of material so heated;

and wherein plastic deformation is produced in said narrow bands, causing the AC watt losses and AC permeability of said ferromagnetic sheet to be reduced, and wherein said AC permeability is reduced by between about 20 and about 52% at an induction of about 13 to about 17 kG.

2. The process according to claim 1 wherein said controlling of said laser beam and said traversing of said laser beam produces a reduction in said AC permeability of between about 29 and about 52 percent.

3. The process according to claim 2 wherein said laser beam is a $CO_2$ laser beam.

4. The process according to claim 3 wherein said laser beam is operating in a continuous wave mode.

5. The process according to claim 1 further comprising the step of selecting a grain oriented sheet steel as said ferromagnetic sheet material.

6. The process according to claim 5 wherein said grain oriented steel is a high permeability type grain oriented steel.

7. The process according to claim 4 wherein said laser beam produces an elongated irradiation spot on said sheet with the major dimension of said elongated irradiation spot being parallel to its direction of travel across said sheet.

8. The process according to claim 1 wherein said laser beam has an incident power density of less than that required to produce shock deformation in said sheet and an incident energy density of greater than 10 and less than 200 joules/cm$^2$.

9. The process according to claim 8 wherein said laser beam is a Neodymium YAG laser operating in a CW mode.

10. The process according to claim 8 wherein said laser beam is a $CO_2$ operating in an extended pulse mode.

11. The process according to claim 8 wherein said laser beam is a 1.06 micron wavelength laser operating in an extended pulse mode.

12. The process according to claim 8 wherein said laser is operating in an extended pulse mode.

13. The process according to claim 3 wherein said ferromagnetic sheet material is a high permeability grain oriented silicon steel and said film is a stress coating; and wherein said laser beam has an incident power density of between about $1\times10^3$ and $1\times10^5$ watts/cm$^2$, a dwell time of about 0.1 to 5 milliseconds, and an incident energy density of about 11 to 50 joules/cm$^2$.

14. The process according to claim 3 wherein said laser beam is operating in an extended pulse mode.

15. The process according to claim 8 wherein said laser beam is a Neodymium Glass laser operating in a CW mode.

* * * * *